US011498804B2

(12) United States Patent
SR et al.

(10) Patent No.: US 11,498,804 B2
(45) Date of Patent: Nov. 15, 2022

(54) PROGNOSTIC FAILURE DETECTION OF ELEVATOR ROLLER GUIDE WHEEL

(71) Applicant: OTIS ELEVATOR COMPANY, Farmington, CT (US)

(72) Inventors: Serralathan SR, Telangana (IN); Vinod Vejandla, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 876 days.

(21) Appl. No.: 16/391,706

(22) Filed: Apr. 23, 2019

(65) Prior Publication Data

US 2019/0322484 A1 Oct. 24, 2019

(30) Foreign Application Priority Data

Apr. 23, 2018 (IN) ..... 201811015362

(51) Int. Cl.

| | |
|---|---|
| ***B66B 5/00*** | (2006.01) |
| ***B66B 1/28*** | (2006.01) |
| ***B66B 7/04*** | (2006.01) |
| ***B66B 9/00*** | (2006.01) |

(52) U.S. Cl.

CPC ..... *B66B 5/0025* (2013.01); *B66B 1/28* (2013.01); *B66B 7/046* (2013.01); *B66B 9/00* (2013.01)

(58) Field of Classification Search

CPC ..... B66B 5/0025; B66B 1/28; B66B 7/046; B66B 1/3476; B66B 5/06

See application file for complete search history.

(56) References Cited

U.S. PATENT DOCUMENTS

| | | | |
|---|---|---|---|
| 2,100,169 | A | 11/1937 | Norton |
| 5,086,882 | A | 2/1992 | Sugahara et al. |
| 5,117,946 | A | 6/1992 | Traktovenko et al. |
| 5,304,751 | A | 4/1994 | Skalski et al. |
| 5,321,217 | A | 6/1994 | Traktovenko et al. |
| 5,439,075 | A | 8/1995 | Skalski et al. |
| 5,715,914 | A | 2/1998 | Traktovenko |
| 5,824,976 | A | 10/1998 | Jamieson et al. |

(Continued)

FOREIGN PATENT DOCUMENTS

| | | | |
|---|---|---|---|
| CN | 201190068 | Y | 2/2009 |
| CN | 101780908 | A | 7/2010 |

(Continued)

OTHER PUBLICATIONS

Chinese Office Action for Chinese Application No. 201910312404.7; dated Jul. 31, 2020; 11 pages.

(Continued)

*Primary Examiner* — Diem M Tran
(74) *Attorney, Agent, or Firm* — Cantor Colburn LLP

(57) ABSTRACT

An elevator car guide wheel system includes a guide wheel located at an elevator car, configured to contact a guide rail of an elevator system. The guide wheel includes a wheel hub located at a guide wheel axis, a wheel rim, and a wheel outer portion located at the wheel rim and configured for contact with the guide rail. A magnetic element is located at the guide wheel, and a sensor is located at the guide wheel and is configured to detect rotational direction and rotational speed of the guide wheel about a guide wheel axis via detecting a magnetic field of the magnetic element.

17 Claims, 4 Drawing Sheets

(56) References Cited

U.S. PATENT DOCUMENTS

| | | | | |
|---|---|---|---|---|
| 5,950,771 | A | 9/1999 | Ferrisi et al. | |
| 7,543,686 | B2 | 6/2009 | Kulak et al. | |
| 7,562,749 | B2 | 7/2009 | Race, Sr. et al. | |
| 7,621,377 | B2 | 11/2009 | Husmann | |
| 9,114,954 | B2 | 8/2015 | Boschin et al. | |
| 9,193,565 | B2 | 11/2015 | Piech | |
| 9,567,189 | B2 | 2/2017 | Laughton | |
| 2007/0000732 | A1 | 1/2007 | Kulak et al. | |
| 2007/0062763 | A1 | 3/2007 | Shiratsuki et al. | |
| 2009/0120729 | A1 | 5/2009 | Okamoto et al. | |
| 2017/0059526 | A1 | 3/2017 | Grambichler et al. | |
| 2019/0234985 | A1* | 8/2019 | Billard | B66B 5/06 |

FOREIGN PATENT DOCUMENTS

| | | | | | |
|---|---|---|---|---|---|
| CN | 112079222 | A | * | 12/2020 | B66B 1/32 |
| EP | 1955972 | A1 | | 8/2008 | |
| EP | 2043935 | A1 | | 4/2009 | |
| EP | 2043936 | A1 | | 4/2009 | |
| EP | 3536649 | A2 | | 9/2019 | |
| GB | 2528951 | A | * | 2/2016 | B65G 43/02 |
| GB | 2528951 | A | | 2/2016 | |
| JP | 8333068 | A | | 12/1996 | |
| JP | 2013245076 | A | * | 12/2013 | |

OTHER PUBLICATIONS

European Office Action Issued In EP Application No. 19170110.1, dated Sep. 23, 2019, 10 Pages.

* cited by examiner

PROGNOSTIC FAILURE DETECTION OF ELEVATOR ROLLER GUIDE WHEEL

FOREIGN PRIORITY

This application claims priority to India Patent Application No. 201811015362, filed Apr. 23, 2018, and all the benefits accruing therefrom under 35 U.S.C. § 119, the contents of which in its entirety are herein incorporated by reference.

BACKGROUND

Exemplary embodiments pertain to the art of elevator systems, and more particularly to monitoring and detecting condition of roller guide wheels of the elevator system.

In typical elevator systems, an elevator car interfaces with a guide rail of the elevator system via one or more guide wheels located at the elevator car. The roller guide wheels contact the guide rail and guide the elevator car through the hoistway along the guide rail.

Defective roller guide wheels, such as those that rotate more slowly than required, or which stop rotating due to mechanical failure, can be hazardous in elevator system operation. Further, this defective roller guide wheel greatly increases the noise and vibration of the operating elevator due to increased friction between defective roller wheel and rail guide. The defective roller guide wheel also affects the operating condition of other roller wheels which leads to increase in service cost, and may also greatly affect the safety of in-car passengers.

BRIEF DESCRIPTION

In one embodiment, an elevator car guide wheel system includes a guide wheel located at an elevator car, configured to contact a guide rail of an elevator system. The guide wheel includes a wheel hub located at a guide wheel axis, a wheel rim, and a wheel outer portion located at the wheel rim and configured for contact with the guide rail. A magnetic element is located at the guide wheel, and a sensor is located at the guide wheel and is configured to detect rotational direction and rotational speed of the guide wheel about a guide wheel axis via detecting a magnetic field of the magnetic element.

Additionally or alternatively, in this or other embodiments the sensor is Hall-Effect sensor.

Additionally or alternatively, in this or other embodiments a rotational speed and/or direction outside of a threshold is indicative or damage or failure of the guide wheel.

Additionally or alternatively, in this or other embodiments the sensor is operably connected to an elevator system controller.

Additionally or alternatively, in this or other embodiments the magnetic element is one of a magnetic ring or an adhesive magnetic tape.

In another embodiment, an elevator system includes a guide rail, an elevator car operably connected to and movable along the guide rail, and one or more elevator car guides to operably connect the elevator car to the guide rail. Each elevator car guide includes a guide wheel located at an elevator car, configured to contact a guide rail of an elevator system. The guide wheel includes a wheel hub located at a guide wheel axis, a wheel rim, and a wheel outer portion located at the wheel rim and configured for contact with the guide rail. A magnetic element is located at the guide wheel, and a sensor is located at the guide wheel and is configured to detect rotational direction and rotational speed of the guide wheel about a guide wheel axis via detecting a magnetic field of the magnetic element.

Additionally or alternatively, in this or other embodiments the sensor is Hall-Effect sensor.

Additionally or alternatively, in this or other embodiments a rotational speed and/or direction outside of a threshold is indicative or damage or failure of the guide wheel.

Additionally or alternatively, in this or other embodiments the sensor is operably connected to an elevator system controller.

Additionally or alternatively, in this or other embodiments the elevator system controller is configured to compare the detected rotational speed and direction to an expected rotational speed and direction.

Additionally or alternatively, in this or other embodiments the elevator system controller urges stopping of operation of the elevator car if the rotational speed and/or direction is outside of an expected threshold.

Additionally or alternatively, in this or other embodiments a plurality of guide wheels are located at the elevator car and a sensor is located at each guide wheel of the plurality of guide wheels.

Additionally or alternatively, in this or other embodiments a first rotational speed of a first guide wheel of the plurality of guide wheels is compared to a second rotational speed of a second guide wheel of the plurality of guide wheels, a difference in rotational speed indicative of damage or failure of the first guide wheel or the second guide wheel.

Additionally or alternatively, in this or other embodiments the magnetic element is one of a magnetic ring or an adhesive magnetic tape.

In yet another embodiment, a method of operating an elevator system includes moving an elevator car along a guide rail, the elevator car operably connected to the guide rail via a guide wheel. The guide wheel includes a wheel hub located at a guide wheel axis, a wheel rim, a wheel outer portion located at the wheel rim and configured for contact with the guide rail, and a magnetic element disposed at the guide wheel. A direction and speed of rotation of the guide wheel is detected via a sensor interactive with the magnetic element. The detected direction and speed of rotation of the guide wheel is compared to an expected direction and speed of rotation. A result of the comparison is indicative of a condition of the guide wheel.

Additionally or alternatively, in this or other embodiments a direction and/or speed of rotation outside of a threshold is indicative of damage or failure of the guide wheel.

Additionally or alternatively, in this or other embodiments operation of the elevator car is stopped based on a result of the comparison.

Additionally or alternatively, in this or other embodiments a first rotational speed of a first guide wheel located at the elevator car is compared to a second rotational speed of a second guide wheel located at the elevator car. A difference between the first rotational speed and the second rotational speed is indicative of damage or failure of one of the first guide wheel or the second guide wheel.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
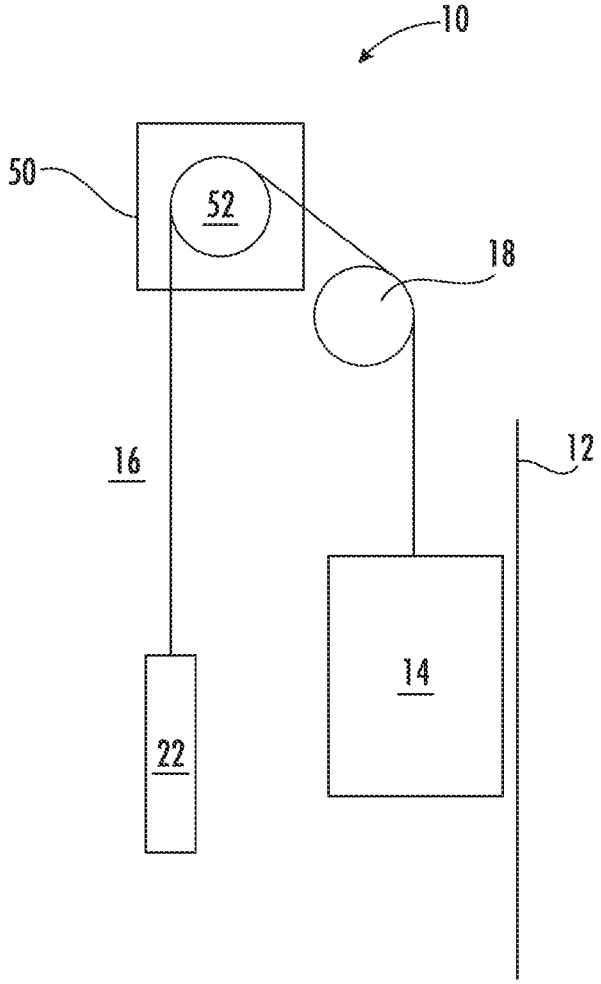
FIG. 1 is a schematic view of an embodiment of an elevator system.

Shown in FIG. 1 is a schematic view of an exemplary traction elevator system 10. The elevator system 10 includes an elevator car 14 operatively suspended or supported in a hoistway 12 with one or more load bearing members, such as a rope or a belt 16. The belt 16 interacts with sheaves 18 and 52 to be routed around various components of the elevator system 10. Sheave 18 is configured as a diverter, deflector or idler sheave and sheave 52 is configured as a traction sheave, driven by a machine 50. Movement of the traction sheave 52 by the machine 50 drives, moves and/or propels (through traction) the belt 16 that is routed around the traction sheave 52. Diverter, deflector or idler sheaves 18 are not driven by a machine 50, but help guide the belt 16 around the various components of the elevator system 10. The belt 16 could also be connected to a counterweight 22, which is used to help balance the elevator system 10 and reduce the difference in belt tension on both sides of the traction sheave 52 during operation. The sheaves 18 and 52 each have a diameter, which may be the same or different from each other.

In some embodiments, the elevator system 10 could use two or more belts 16 for suspending and/or driving the elevator car 14 In addition, the elevator system 10 could have various configurations such that either both sides of the one or more belts 16 engage the sheaves 18, 52 or only one side of the one or more belts 16 engages the sheaves 18, 52. The embodiment of FIG. 1 shows a 1:1 roping arrangement in which the one or more belts 16 terminate at the car 14 and counterweight 22, while other embodiments may utilize other roping arrangements.

Figure 2:
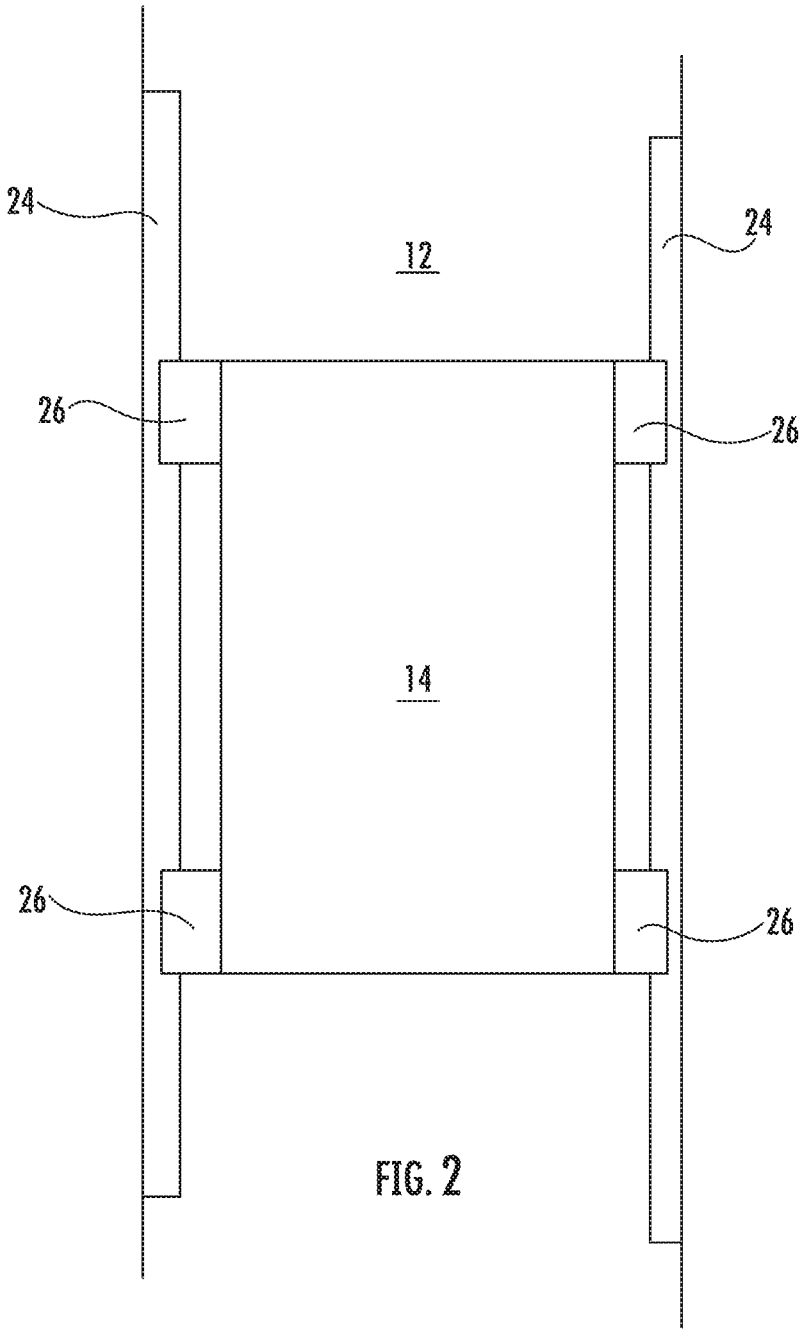
FIG. 2 is another schematic view of an embodiment of an elevator system.

Referring to FIG. 2, the elevator car 14 travels in the hoistway 12 along a path of one or more guide rails 24 arranged in the hoistway 12. In the embodiment of FIG. 2, two guide rails 24 located at opposing sides of the elevator car 14 are utilized, but it is to be appreciated that in other embodiments other numbers of guide rails 24 may be utilized, such as one or four guide rails 24. Car guides 26 mounted at the elevator car 14 interact with the guide rails 24, thereby guiding the elevator car 14 along the path of the guide rails 24. In some embodiments, such as shown in FIG. 2, the elevator car 14 includes four car guides 26, with two car guides 26 located to be interactive with each of the guide rails 24. It is to be appreciated, however, that in other embodiments other quantities of car guides 26 may be utilized.

Figure 3:
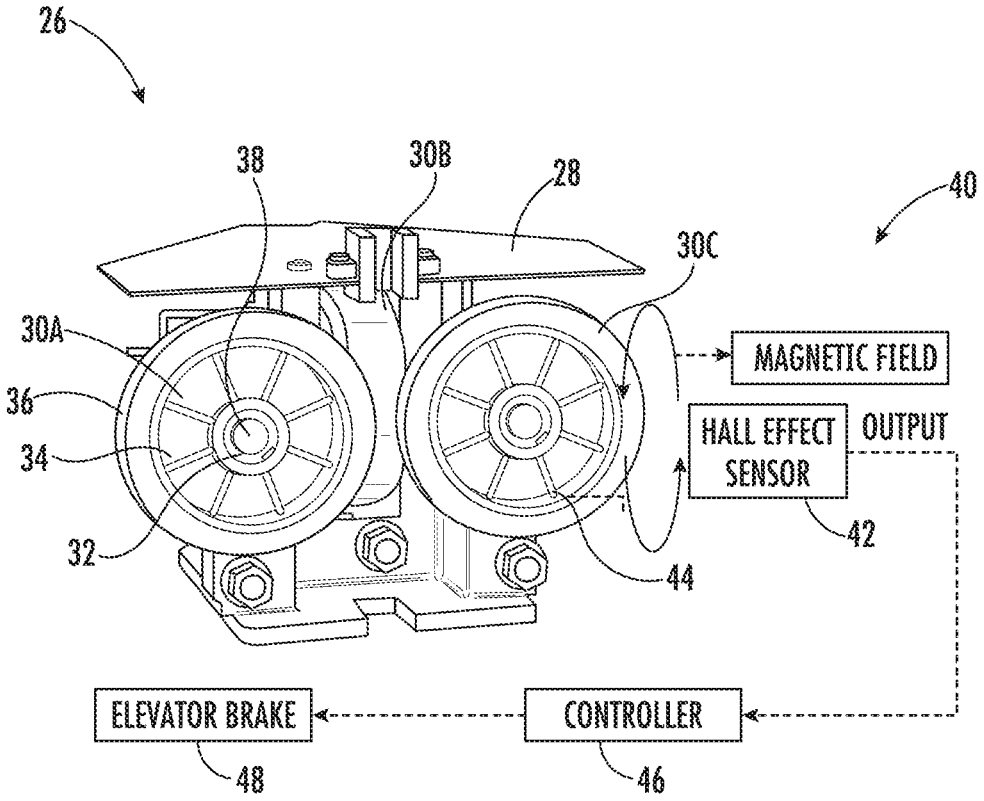
FIG. 3 is a perspective schematic view of an embodiment of a guide wheel arrangement of an elevator system.
Figure 4:
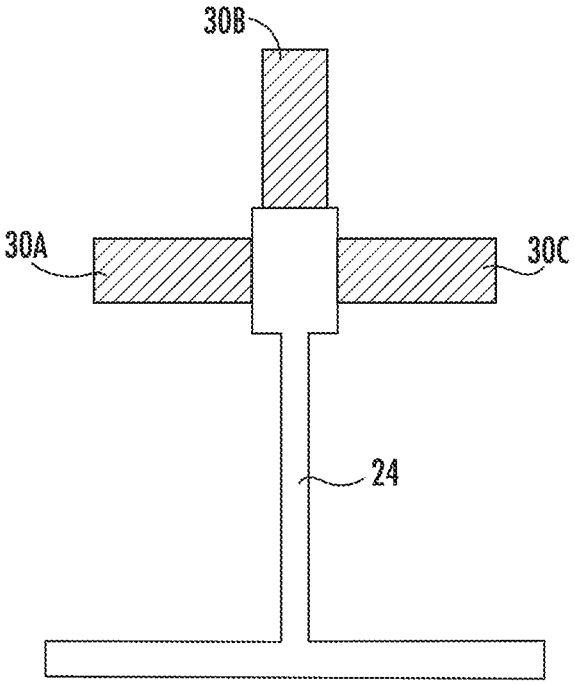
FIG. 4 is a plan view of an embodiment of a guide wheel arrangement of an elevator system.

Referring now to FIG. 3, an exemplary car guide 26 is shown in more detail. The car guide 26 includes a guide base 28 fixed to the elevator car 14. A plurality of guide wheels 30 are secured to the guide base 28. While in the embodiment of FIG. 3, three guide wheels 30 are utilized, it is to be appreciated that in other embodiments other quantities of guide wheels 30, such as one or two guide wheels 30 may be used. Each guide wheel 30 includes a wheel hub 32, and a wheel rim 34. An outer wheel portion 36 is mounted at the wheel rim 34 and provides an interface between the guide wheel 30 and the guide rail 14. The guide wheels 30 are configured to contact the guide rail 14 as the elevator car 14 travels along the hoistway 12, as shown best in FIG. 4. As the elevator car 14 travels along the hoistway 12, the guide wheel 30 remains in contact with the guide rail 24 and rotates about a guide wheel axis 38.

Referring again to FIG. 3, damage to or failure of the guide wheel 30 may reduce performance of the elevator system 10, and may increase noise and/or vibration sensed by passengers in the elevator car 12. Such damage or failure of the guide wheel 30 often results in stopping slowing of rotation of the guide wheel 30 about the guide wheel axis 38, resulting in increased friction between the guide wheel 30 and the guide rail 24. A monitoring system 40 is connected to the guide wheel 30 to detect rotation of the guide wheel 30, and thus detecting damage to or failure of the guide wheel 30 if a rotational speed is detected, which is less than a selected value, based on travel speed of the elevator car 14 along the hoistway. 12.

The monitoring system 40 includes a plurality of sensors, for example a Hall-Effect sensor 42 disposed at each of the guide wheels 30. The Hall-Effect sensor 42 is located in proximity to the guide wheel 30 to detect rotational direction and speed of the guide wheel 30. To facilitate such detection, a magnetic element 44 such as a magnetic ring or an adhesive magnetic strip located at the wheel rim 34. Thus, the Hall-Effect sensor 42 detects the direction and speed of rotation of the guide wheel 30 through fluctuations in the magnetic field generated by the magnetic element 44.

Speed and direction data from the Hall-Effect sensor 42 is output to an elevator system controller 46. At the controller, the speed and direction data is continuously evaluated to determine a condition of the guide wheel 30. For example, the detected rotational speed and direction is compared to a speed of the elevator car 14 along the hoistway 12. A difference between the rotational speed of the guide wheel 30 and the speed of the elevator car 14 outside of a selected speed threshold may be indicative of damage or failure of the guide wheel 30. Further, in some embodiments, the rotational speed of a first guide wheel 30A (shown in FIG. 4) is compared to rotational speeds of other guide wheels 30B and 30C of the car guide 26. A difference in the rotational speeds of guide wheels 30A, 30B and 30C is indicative of damage or failure of one or more of the guide wheels 30A, 30B or 30C. In most cases, when the rotational speed of a guide wheel 30 is below an expected rotations speed, or lower than the rotational speed of other guide wheels 30, it indicates that the guide wheel 30 is damaged or worn.

When such a guide wheel 30 damage or failure condition is determined by the elevator system controller 46 based on the detected rotational speed and/or direction of the guide wheel 30, the elevator system controller 46 will stop operation of the elevator system 10 by, for example, signaling an elevator system brake 48 to stop the elevator car 14 in a safe condition. In some embodiments, the elevator system controller 46 may signal a maintenance or repair alert via an alarm or other communication.

Additionally, the monitoring system 40 may be utilized to detect an overspeed condition of the elevator car 14, when the detected rotational speed of the guide wheel 30 exceeds an expected value. In such cases, the elevator control system 46 signals an elevator safety brake (not shown) to stop the elevator car 14.

The monitoring system 40 disclosed herein monitors guide wheel 30 rotation to detect damage or failure of the guide wheel 30. Early detection of such conditions reduces service down time and cost related to the elevator system.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator car guide wheel system, comprising:
- a guide wheel disposed at an elevator car, configured to contact a guide rail of an elevator system, the guide wheel including:
  - a wheel hub disposed at a guide wheel axis;
  - a wheel rim; and
  - a wheel outer portion disposed at the wheel rim and configured for contact with the guide rail;
- a magnetic element disposed at the wheel rim; and
- a sensor disposed in proximity to the guide wheel configured to detect rotational direction and rotational speed of the guide wheel about the guide wheel axis via detecting a magnetic field of the magnetic element;
- wherein a rotational speed and/or direction outside of a threshold is indicative of damage or failure of the guide wheel.

2. The elevator car guide wheel system of claim 1, wherein the sensor is Hall-Effect sensor.

3. The elevator car guide wheel system of claim 1, wherein the sensor is operably connected to an elevator system controller.

4. The elevator guide wheel system of claim 1, wherein the magnetic element is one of a magnetic ring or an adhesive magnetic tape.

5. An elevator system, comprising:
- a guide rail;
- an elevator car operably connected to and movable along the guide rail;
- one or more elevator car guides to operably connect the elevator car to the guide rail, each elevator car guide including:
  - a guide wheel disposed at an elevator car, configured to contact a guide rail of an elevator system, the guide wheel including:
    - a wheel hub disposed at a guide wheel axis;
    - a wheel rim; and
    - a wheel outer portion disposed at the wheel rim and configured for contact with the guide rail;
  - a magnetic element disposed at the wheel rim; and
  - a sensor disposed in proximity to the guide wheel configured to detect rotational direction and rotational speed of the guide wheel about the guide wheel axis via detecting a magnetic field of the magnetic element;
  - wherein a rotational speed and/or direction outside of a threshold is indicative or damage or failure of the guide wheel.

6. The elevator system of claim 5, wherein the sensor is Hall-Effect sensor.

7. The elevator system of claim 5, wherein a rotational speed and/or direction outside of a threshold is indicative or damage or failure of the guide wheel.

8. The elevator system of claim 5, wherein the sensor is operably connected to an elevator system controller.

9. The elevator system of claim 8, wherein the elevator system controller is configured to compare the detected rotational speed and direction to an expected rotational speed and direction.

10. The elevator system of claim 9, wherein the elevator system controller urges stopping of operation of the elevator car if the rotational speed and/or direction is outside of an expected threshold.

11. The elevator system of claim 5, further comprising:
- a plurality of guide wheels disposed at the elevator car; and
- a sensor disposed at each guide wheel of the plurality of guide wheels.

12. The elevator system of claim 11, wherein a first rotational speed of a first guide wheel of the plurality of guide wheels is compared to a second rotational speed of a second guide wheel of the plurality of guide wheels, a difference in rotational speed indicative of damage or failure of the first guide wheel or the second guide wheel.

13. The elevator system of claim 5, wherein the magnetic element is one of a magnetic ring or an adhesive magnetic tape.

14. A method of operating an elevator system, comprising:
- moving an elevator car along a guide rail, the elevator car operably connected to the guide rail via a guide wheel, the guide wheel including:
  - a wheel hub disposed at a guide wheel axis;
  - a wheel rim;
  - a wheel outer portion disposed at the wheel rim and configured for contact with the guide rail; and
  - a magnetic element disposed at the wheel rim;
- detecting a direction and speed of rotation of the guide wheel via a sensor interactive with the magnetic element, the sensor disposed in proximity to the guide wheel; and
- comparing the detected direction and speed of rotation of the guide wheel to an expected direction and speed of rotation;
- wherein a result of the comparison is indicative of a condition of the guide wheel;
- wherein a direction and/or speed of rotation outside of a threshold is indicative of damage or failure of the guide wheel.

15. The method of claim 14, wherein a direction and/or speed of rotation outside of a threshold is indicative of damage or failure of the guide wheel.

16. The method of claim 14, further comprising stopping operation of the elevator car based on a result of the comparison.

17. The method of claim 14, further comprising comparing a first rotational speed of a first guide wheel disposed at the elevator car to a second rotational speed of a second guide wheel disposed at the elevator car, a difference between the first rotational speed and the second rotational speed indicative of damage or failure of one of the first guide wheel or the second guide wheel.

* * * * *